United States Patent [19]

Adams

[11] Patent Number: 4,951,968

[45] Date of Patent: Aug. 28, 1990

[54] PERIODIC REMINDER SYSTEM

[76] Inventor: Mary Adams, 36 Main St. #13, North Reading, Mass. 01864

[21] Appl. No.: 368,806

[22] Filed: Jun. 20, 1989

[51] Int. Cl.[5] ..... B42D 11/00; G09D 3/02

[52] U.S. Cl. ..... 281/45; 40/122; 40/120; 220/337

[58] Field of Search ..... 281/45; 40/358, 661, 40/107, 120, 121, 122; 206/38, 232; 220/337

[56] References Cited

U.S. PATENT DOCUMENTS

| | | | |
|---|---|---|---|
| 528,545 | 11/1894 | Krueger | 40/122 |
| 993,330 | 5/1911 | Walker | 40/120 X |
| 1,463,210 | 7/1923 | Harris | 40/122 |
| 1,719,840 | 7/1929 | Horix | 40/122 X |
| 2,907,584 | 10/1959 | Neilsen | 40/358 |
| 3,381,850 | 5/1968 | Haugen | 220/337 X |
| 3,473,249 | 10/1969 | Ankrum | 40/107 |
| 4,431,114 | 2/1984 | Kleinfeld | 220/337 |

FOREIGN PATENT DOCUMENTS

| | | | |
|---|---|---|---|
| 74119 | 2/1918 | Austria | 40/122 |

*Primary Examiner*—Paul A. Bell
*Assistant Examiner*—Hwei-Siu Payer
*Attorney, Agent, or Firm*—Gregory J. Nelson

[57] ABSTRACT

A reminder system for reminding a user that an action is to be taken, such as a pledge payment. In the preferred embodiment the system includes a dispensing tray containing a packet of collated materials. The collated materials comprise calendar pages with remittance envelopes interposed between calendar pages. When a calendar page is removed from the stack, a remittance envelope is revealed which the user may use to mail the scheduled payment. A panel is engageable at the rear of the tray to display information or decorative indicia.

6 Claims, 1 Drawing Sheet

FIG. 1
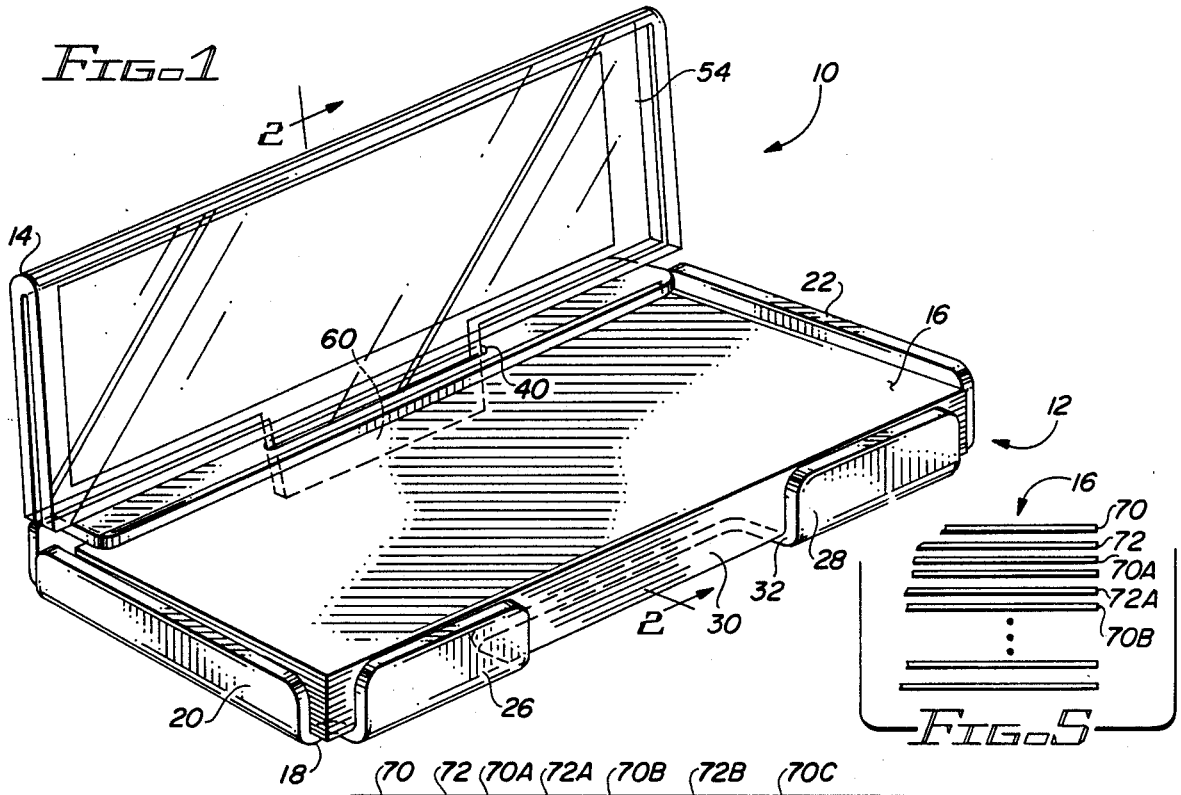
FIG. 5
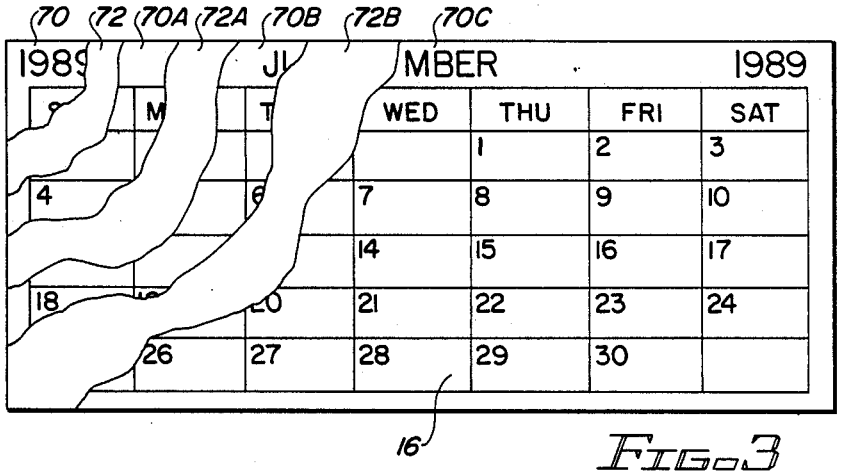
FIG. 3
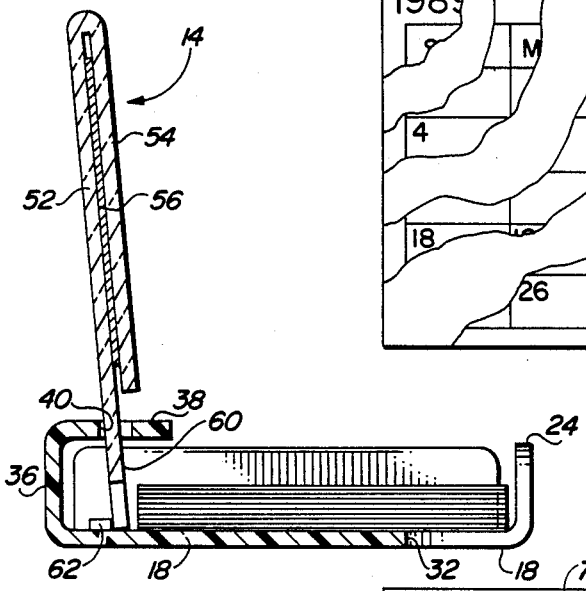
FIG. 2
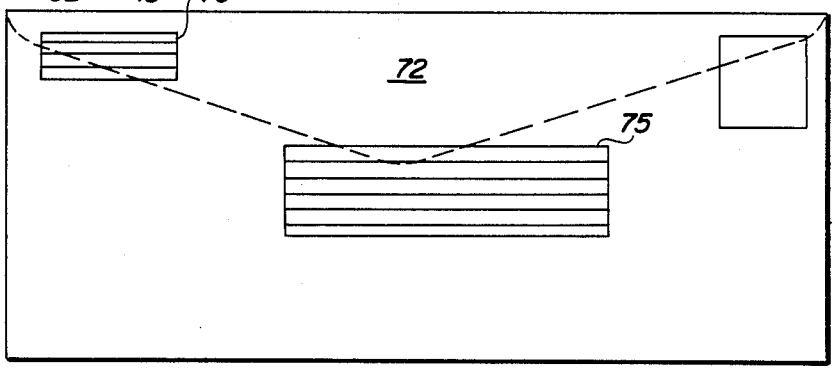
FIG. 4

PERIODIC REMINDER SYSTEM

The present invention relates to a reminder system and more particularly to a system for periodically reminding the user of a periodic payment or action that is required and which system further includes a wrapper or envelope for the remittance of the payment or action.

It is common for charities and religious organizations to obtain pledges from their members, patrons or sponsors which require that the member, patron or sponsor regularly send an installment payment to the organization as, for example, at the beginning of each month. It is time-consuming and expensive for an organization of this type to maintain records of such pledges and of payments received and to send reminders when necessary. In the event a payment is not received, it may seem inappropriate for a charitable or religious organization to send out a reminder when the pledge is a voluntary donation.

In addition to charitable or religious pledges, many consumers in commercial arrangements are required to make installment or periodic payments to banks or other lending institutions. While these institutions are less reluctant to send out payment reminders, the cost of sending such reminders and the processing of late payments imposes administrative if not financial burden on such institutions.

In view of this, there exists a need for a simple, effective and convenient system for reminding individuals that a remittance is due or some action must be timely taken. Generally the remittance or action must be taken at regularly scheduled intervals, as for example monthly. Often these payments or communications are required on or about the first of the month. Accordingly, the present invention provides a convenient reminder system for reminding persons that some action is required which system also provides the user with an envelope for the remittance of the payment or communication.

Briefly, the present invention provides a tray-like dispenser which contains a looseleaf packet of collated materials suitable for placement on a desk or table. In the preferred embodiment of the invention, the packet of collated materials consist of informational members such as calendar pages with activity members such as wrappers or envelopes alternately interposed between the calendar pages. The calendar pages contain the usual tabulation of days in a particular time period. Thus, when a predetermined time period has passed, the corresponding calendar page may be manually removed by the user revealing a preaddressed envelope for containment of a payment or other communication or action which is required to be made by the user during the next successive time period. The tray preferably contains a display cover panel which when the tray is placed in use is erected in an upright position containing visual material which will serve to reinforce and remind the user of the required action.

Accordingly, it is a broad object of the present invention to provide a unique reminder system having a compact dispenser containing a packet of collated materials including one or more wrappers or envelopes which are periodically presented to the user for remittance of the required payment or other communication.

It is another object of the present invention to provide a reminder system having a dispenser tray with a cover which display cover panel can be erected to an upright position to display information to the user to reinforce the reminder of the required periodic remittance.

A more specific object of the present invention is to provide a pledge reminder system for charitable or religious organizations which includes a looseleaf pack of alternately arranged calendar page and envelope in a convenient dispenser tray.

The above and other objects and advantages of the present invention will become more apparent from the following specification and claims taken in conjunction with the drawings in which:

FIG. 1 is a perspective view of the reminder system of the present invention with the display cover panel in an erected position;

FIG. 2 is a sectional view taken along lines 2—2 of FIG. 1;

FIG. 3 is a plan view partly broken away of the collated printed material of the reminder system;

FIG. 4 is a front view of a remittance envelope contained within the collated materials as shown in FIGS. 3 and 5; and FIG. 5 is a partial vertical sectional view illustrating the collation sequence of the materials shown in FIG. 3.

Turning now to the drawings, the reminder system of the present invention is generally designated by the numeral 10 and includes a dispensing tray 12, display cover panel 14 and a packet of collated materials 16.

The dispensing tray 12 is preferably fabricated from a material such as plastic. A clear or transparent plastic such as Lucite is preferred. Tray 12 has a generally planar bottom 18 with integrally formed upstanding opposite side walls 20 and 22. Upstanding front wall 24 is integrally formed as part of the tray and the front wall consists of spaced-apart upstanding flange members 26 and 28 defining a central space 30 therebetween. A recess or cutout 32 is provided in the front edge of the bottom wall 18 extending rearwardly from the interior edges of the flanges 26 and 28 so that the user may easily and conveniently grasp one or more sheets of the collated material 16 contained within the tray.

The rear wall 36 is also integrally formed as part of the tray extending vertically at the rear edge of the bottom wall 18 and including a forwardly extending flange portion 38. A transversely extending slot or aperture 40 is centrally provided in the forwardly horizontally extending wall 38.

Display cover panel 14 is shown in the erected position in FIGS. 1 and 2. The display cover consists of a rear panel member 52 and a front panel member 54 defining a slot 56 therebetween for reception of display materials. Slot 56 is open at least one marginal edge for reception of printed materials which may be informational or simply be a decorative display.

A centrally positioned tab 60 extends from the lower edge of the rear wall and is adapted to be inserted in the transversely extending slot 40. As best seen in FIG. 2, a transversely extending rib 62 is provided on the interior surface of bottom wall 18 to receive the bottom edge of tab 60 to support the display cover in the erected position shown in FIGS. 1 and 2. In the erected position, the display tilts slightly rearwardly.

To place the system in the stored compact position, the display cover panel 14 is removed and withdrawn from the transversely extending slot 40 and inserted in a generally horizontal position overlying the collated materials 16. In this position, the mounting tab will assume a position beneath the horizontal extension of the rear wall 36 and the dispenser, tray cover and materials are compact for storage and shipping.

The collated packet of materials 16 is best shown in FIGS. 3, 4 and 5. Typically, the system of the present invention is used to remind the user of a periodic payment or communication, as for example a monthly pledge to a charitable or religious organization. As shown, the collated packet consists of alternate sheets or pages of monthly calendars 70, 70A, 70B, etc. with interposed remittance envelopes 72, 72A, 72C, etc. As best shown in FIG. 3, the calendar sheets are periodic, as for example weekly or monthly, setting forth the month, day and date in a tabulated arrangement with other information as is commonly displayed on a calendar. Alternately interposed between the calendar pages are remittance envelopes 72, 72A, 72B, etc. As shown in FIG. 4, the remittance envelope, as represented by envelope 72, are preferably preaddressed to the recipient at 75 and may contain appropriate identification of the sender 76 and may include appropriate remittance coupons.

The remittance reminder system of the present invention will be better understood from the following description of use.

In the event an individual is required to take some periodic action such as the mailing of a monthly payment, the remittance system will be provided to the person. For example, a charitable or religious organization upon receiving a pledge will provide the system to the individual. The system can be conveniently packaged and even mailed as the dispenser tray 12 has a low profile. For compactness for storage or mailing, the display panel cover 14 is placed in a generally horizontal position overlying the collated materials 16.

When the reminder system is received by the user, the dispenser tray 12 is placed in an appropriate position such as on the desk of the user. The display cover panel 14 is removed and erected in an upright position by inserting the tab 60 into the transversely extending slot 40 with the bottom edge of the tab engaging rib 62 in the bottom of the tray. In the inserted or erected position, the display cover panel 14 tilts slightly rearwardly as seen in FIG. 2. Appropriate display or informational material has been inserted in the slot 56 in the panel and is presented to the user. For example, such informational material would typically promote the organization providing the reminder system to the user. This display will serve to reinforce and further remind the user that a periodic action is required on the part of the user.

In place on a desk or similar location, the system serves as a convenient calendar display covering a predetermined time period. For example, as shown in FIG. 3, the top sheet 70 is shown as a monthly calendar for the convenient reference and use of the person with appropriate month, day and date indicated. Other information commonly contained on a calendar such as designation of holidays and the like may be set forth. The calendar is shown as having space for insertion of notations and appointments by the user. At the conclusion of the time period, as for example the end of the month, the top calendar sheet 70 is removed and discarded. When this is done, remittance envelope 72 underlying the calendar sheet is immediately displayed. This will serve as a convenient reminder to the user that some action is required, as for example, sending of a pledge payment to the organization or institution. The remittance envelope is convenient as it is preaddressed at 75. The envelope may contain an appropriate payment coupon so proper credit is afforded the user. The user simply places the information or, in the case of a payment, a check or other remittance in the envelope, seals the envelope at the flap and posts the envelope. When the envelope 72 is removed and posted, the calendar page 70A for the next succeeding period of time is revealed to the user.

In the preferred embodiment of the invention shown, the collated material consists of twelve monthly calendar sheets and interposed envelopes. The collated materials may be looseleaf although in some applications it may be desirable to provide a separable binding along one vertical edge of the materials.

It will be obvious to those skilled in the art to make various changes, alterations and modifications to the periodic reminder system of the present invention. To the extent such changes, alterations and modifications do not depart from the spirit and scope of the appended claims, they are intended to be encompassed therein.

I claim:

1. A reminder system comprising a tray having a bottom and upstanding at least one said tray containing a packet of collated materials including a plurality of informational members having a plurality of remittance members interposed between selected of said informational members whereby removal of selected one of said informational members will reveal selected one of said remittance members for the convenience of the user, said remittance members being chronologically related to said informational members.

2. The reminder system of claim 1 wherein said informational members comprise calendar sheets and said remittance members comprise preaddressed envelopes.

3. The reminder system of claim 2 in which at least a portion of the said upstanding wall of said tray is relieved to facilitate manual access to the collated materials.

4. The reminder system of claim 3 wherein said upstanding wall includes a forwardly extending, generally horizontal flange defining a generally transverse slot therein and further including a cover panel having a tab engageable in said slot to selectively position said cover panel in a generally vertical position with respect to said tray.

5. The reminder system of claim 4 wherein said cover member is adapted to receive informational material.

6. The reminder system of claim 4 wherein said cover panel is configured to be received in a generally horizontal position overlying said collated materials.

* * * * *

UNITED STATES PATENT AND TRADEMARK OFFICE

CERTIFICATE OF CORRECTION

PATENT NO. : 4,951,968

DATED : August 28, 1990

INVENTOR(S) : MARY ADAMS

It is certified that error appears in the above-identified patent and that said Letters Patent is hereby corrected as shown below:

Column 4, lines 30-40, claim 1 should read as follows:

1. A reminder system comprising a tray having a bottom and at least one upstanding wall, said tray containing a packet of collated materials including a plurality of informational members having a plurality of remittance members interposed between selected of said informational members whereby removal of selected one of said informational members will reveal selected one of said remittance members for the convenience of the user, said remittance members being chronologically related to said informational members.

Signed and Sealed this

Ninth Day of June, 1992

*Attest:*

DOUGLAS B. COMER

*Attesting Officer*

*Acting Commissioner of Patents and Trademarks*